US011598484B2

(12) United States Patent
Wei et al.

(10) Patent No.: US 11,598,484 B2
(45) Date of Patent: Mar. 7, 2023

(54) BIMETALLIC CRYOGENIC MEMBRANE STORAGE COMPARTMENT FOR LNG STORAGE

(71) Applicant: SINOTECH MARINE CO., LTD., Shanghai (CN)

(72) Inventors: Ying Wei, Shanghai (CN); Shifu Chen, Shanghai (CN); Wei He, Shanghai (CN)

(73) Assignee: SINOTECH MARINE CO., LTD., Shanghai (CN)

( * ) Notice: Subject to any disclaimer, the term of this patent is extended or adjusted under 35 U.S.C. 154(b) by 0 days.

(21) Appl. No.: 17/519,113

(22) Filed: Nov. 4, 2021

(65) Prior Publication Data

US 2022/0146045 A1 May 12, 2022

(30) Foreign Application Priority Data

Nov. 6, 2020 (CN) ..... 202011228431.5

(51) Int. Cl.
*F17C 3/04* (2006.01)
*B63B 25/14* (2006.01)
(Continued)

(52) U.S. Cl.
CPC ..... *F17C 3/04* (2013.01); *B63B 25/14* (2013.01); *F17C 3/027* (2013.01); *F17C 13/001* (2013.01);
(Continued)

(58) Field of Classification Search
CPC ..... F17C 3/04; F17C 3/027; F17C 13/001; F17C 2203/035; F17C 2203/0624;
(Continued)

(56) References Cited

U.S. PATENT DOCUMENTS

| | | | | |
|---|---|---|---|---|
| 5,501,359 | A | 3/1996 | Chauvin et al. | |
| 7,204,195 | B2 * | 4/2007 | Yang | F17C 3/027 220/560.07 |
| 7,896,188 | B2 * | 3/2011 | Jordan | B65D 19/00 220/9.4 |
| 9,677,711 | B2 * | 6/2017 | Boyeau | B63B 27/25 |
| 10,293,892 | B2 * | 5/2019 | Delanoe | F17C 3/06 |
| 10,316,516 | B2 * | 6/2019 | Carlyon | E04C 2/292 |

(Continued)

FOREIGN PATENT DOCUMENTS

| | | | |
|---|---|---|---|
| CN | 1898124 | A | 1/2007 |
| CN | 101688640 | A | 3/2010 |

(Continued)

*Primary Examiner* — Shawn M Braden
(74) *Attorney, Agent, or Firm* — Oliff PLC

(57) ABSTRACT

The invention discloses a bimetallic cryogenic membrane storage compartment for liquefied natural gas (LNG) storage. The invention is based on the design of bimetallic membrane panels and two insulating panels to achieve two completely independent insulation spaces, fully meeting the relevant requirements of the amendments to the International Code for the Construction and Equipment of Ships Carrying Liquefied Natural Gas in Bulk ("IGC CODE") adopted on May 22, 2014. The invention improves the safety of the cryogenic membrane storage compartment, reduces the limitation of free liquid level loading of liquid cargo in the cargo compartment, reduces the application and time consuming of low-temperature resistant glue in the construction process, and adopts the more mature and safe design method of welding bimetallic membrane panels and the environmental protection method of prefabricated foam insulation panels, thus reducing the construction workload, shortening the construction cycle and improving the safety of the equipment.

10 Claims, 5 Drawing Sheets

(51) Int. Cl.
*F17C 3/02* (2006.01)
*F17C 13/00* (2006.01)

(52) U.S. Cl.
CPC ..... *F17C 2203/035* (2013.01); *F17C 2203/0333* (2013.01); *F17C 2203/0624* (2013.01); *F17C 2203/0643* (2013.01); *F17C 2203/0648* (2013.01); *F17C 2209/221* (2013.01); *F17C 2223/0161* (2013.01); *F17C 2270/0107* (2013.01)

(58) Field of Classification Search
CPC ..... F17C 2203/0648; F17C 2223/0161; F17C 2270/0107; F17C 2201/0157; F17C 2201/052; F17C 2203/0358; F17C 2221/033; B63B 25/14; B63B 25/16
See application file for complete search history.

(56) References Cited

U.S. PATENT DOCUMENTS

2015/0285439 A1* 10/2015 Herry ..... F17C 9/00 220/560.12
2016/0069514 A1* 3/2016 Delanoe ..... B63B 1/10 137/565.17

FOREIGN PATENT DOCUMENTS

| | | | |
|---|---|---|---|
| CN | 104245497 | A | 12/2014 |
| CN | 205535032 | U | 8/2016 |
| CN | 106715256 | A | 5/2017 |
| CN | 111316030 | A | 6/2020 |
| CN | 111503509 | A | 8/2020 |
| KR | 1020150033945 | A | 4/2015 |
| WO | 2016/064015 | A1 | 4/2016 |

* cited by examiner

BIMETALLIC CRYOGENIC MEMBRANE STORAGE COMPARTMENT FOR LNG STORAGE

TECHNOLOGY FIELD

This invention relates to the technical field of liquefied natural gas (LNG) cryogenic storage devices, specifically a bimetallic cryogenic membrane storage compartment for LNG storage.

BACKGROUND TECHNOLOGY

Liquefied natural gas (LNG) has been one of the most rapidly developing energy industries globally as the preferred energy source for oil replacement due to its environmental protection and high-efficiency advantages. With the rapid economic development and the increasing requirements for environmental management, the application and development of LNG have received more and more attention from all parties, especially in the case of frequent hazy weather, the importance of LNG has become more and more prominent, thus triggering the rapid growth of society's demand for clean energy. The worldwide LNG transportation industry has been developing for more than 60 years since 1959 when the methane pioneer METHANEPIONEEER started its test operation. During this process, LNG carrier technology has also undergone a continuous upgrading process from small, simple, and single to the current large, complex and special purpose. The LNG ship cargo containment system is one of the core technologies of LNG ships, and its main function is to store LNG cargo with a liquid temperature of −163° C. The enclosure system is the isolation barrier and thermal insulation of the liquid cargo tank, and its main function is to ensure no leakage of LNG through completely dense metal membrane; avoid the loss of strength and toughness of the ship hull due to cooling low temperature through good adiabatic and insulating ability.

The cargo containment system design for LNG ships applied in the market is mainly divided into C-type pressure tank for small and medium-sized LNG ships, MOSS spherical tank type for large LNG ships, GTT MARK III, NO 96 membrane type, and IHI SPB type, among which shipowners favor the membrane type containment system for the advantages of high capacity utilization, small ship size, low fuel consumption, large visibility of the ship and small wind resistance area.

However, the existing storage tanks for LNG storage have the following problems: (1) the existing technology relies heavily on the original storage tank membrane form, the membrane production cost is high, and the supply is extremely limited, the existing technology has a large workload on-site, the amount of glue used is large, the second insulation layer all relies on glue bonding, the safety performance is poor, the docking of the main metallic shielding membrane and the welding of the main metallic shielding layer are all time-consuming. (2) The existing technology has a long construction period, which delays the delivery time of the whole ship due to the strict requirements on the construction environment (humidity and temperature) and process. For this reason, it is necessary to design corresponding technical solutions to solve the existing technical problems.

Invention Content

The present invention provides a bimetallic cryogenic membrane storage compartment for liquefied natural gas storage, solving the technical problems that the prior art relies on the original storage compartment membrane form is relatively high, the membrane production and manufacturing cost is relatively high, and the supply is extremely limited, the workload on the site of the prior art is large, the use of glue is relatively large, the second insulation layer all relies on glue bonding, the safety performance is poor, the docking of the main metallic shielding membrane and the welding of the main metallic shielding layer are all time-consuming and huge.

To achieve the above purpose, the invention provides the following technical solution: a bimetallic cryogenic membrane storage compartment for liquefied natural gas storage, comprising a bimetallic cryogenic membrane storage compartment, said bimetallic cryogenic membrane storage compartment is provided from outside to inside with a hull plate, an epoxy resin with hardener adhesive layer, a first support plate, a first insulating panel, a second support plate, a second metallic shielding membrane, a third support plate, a second insulating panel, a fourth support plate, a main metallic shielding membrane and storage compartment. The first support board and the first insulating panel are built with several groups of studs and fixed on the hull board by the studs and epoxy resin with hardener adhesive layer, several groups of said studs are filled with filling insulating blocks at the periphery, the first insulating panel and the second insulating panel are composed of several standard modular insulating panels, and the periphery of the gap between two adjacent insulating panels is also filled with filling insulating blocks, the said the first insulating panel is connected to the second supporting board, the inner side of said second supporting board is connected to the second metallic shielding membrane and the connection is pre-buried with several sets of strip anchor steel plates, the inner side of said second metallic shielding membrane is in contact with the third supporting board, the tank boundary corners of both said second insulating panel and said first insulating panel are provided with L-shaped corner structure and T-shaped corner structure, the angle range of 90 degrees to 135 degrees, the two sets of said L-shaped corner structure and T-shaped corner structure are provided with L-shaped corner structure and T-shaped corner structure. The two sets of said L corner structure and T corner structure are used to connect the corners of the second metallic shielding membrane and the main metallic shielding membrane, respectively; the inner and outer sides of the said second insulating panel are connected with the third support plate and the fourth support plate, and there are also several sets of bar-shaped steel plates pre-buried on the fourth support plate, the said fourth support plate is in contact with the main metallic shielding membrane, the said second metallic shielding membrane and the main metallic shielding membrane is installed inside the corrugated reinforcement wedge, the said second metallic shielding membrane and the main metallic shielding membrane is installed inside the corrugated reinforcement wedge, the said second metallic shielding membrane and the main metallic shielding membrane is installed inside the corrugated reinforcement wedge, the said second metallic shielding membrane and the main metallic shielding membrane are connected with the third support plate. Membrane and the main metallic shielding membrane are welded together by automatic welding or hand welding, and all gaps created by said design first insulating panel and panel and second insulating panel during installation are filled with flexible insulation or rigid insulation or glass fiber insulation.

As a preferred embodiment of the present invention, said first insulating panel and said second insulating panel are both made of reinforced polyurethane foam material and glass fiber material with a density of 20-300 kg/m3, the thickness of said first insulating panel is 50 mm-500 mm and the thickness of said second insulating panel is 50 mm-500 mm.

As a preferred embodiment of the present invention, said first support plate and first insulating panel are panel are laid on the hull plate and fixed by studs and epoxy resin with hardener adhesive layer. Said epoxy resin with hardener adhesive layer is made by mixing a high polymer and curing agent.

As a preferred embodiment of the present invention, the thickness of both the second and primary main metallic shielding membrane is 0.5 mm-3.0 mm and made of stainless steel plate, 9% nickel steel plate, invar plate or aluminum alloy steel plate, and the shape of the second and primary main metallic shielding membrane is continuous arch-shaped corrugated raised structure.

As a preferred embodiment of the present invention, the reinforcing wedge is mounted on the inside of the corrugation of the second metallic shielding membrane and the primary main metallic shielding membrane, and is fixed to the surface of the fourth support plate and the second support plate by means of bonding or screws or bonding with screws, and the material of the reinforcing wedge is made of wood, metal or a special material.

As a preferred embodiment of the present invention, the outer strip steel plate is fixed on the surface of the second support plate and lap welded with the second metallic shielding membrane, the inner strip steel plate is fixed on the surface of the fourth support plate and lap welded with the main metallic shielding membrane, the thickness of the strip steel plate is 3 mm-15 mm, and the material used is stainless steel plate, 9% nickel steel plate, invar plate or aluminum alloy steel plate.

As a preferred embodiment of the present invention, said connected with the first insulating panel and panel and the second insulating panel is a support plate, such as the first support plate, the second support plate, the third support plate, and the fourth support plate. Said support plate material is wood plywood, fiberglass, tetrafluoroethylene (PFA), polytetrafluoroethylene (PTFE), or polyether ether ketone (PEEK) material, the thickness of which is 2 mm-30 mm, to increase the strength of the insulating panel, and pre-buried with a strip steel plate.

As a preferred embodiment of the present invention, the L-shaped corner structure and T-shaped corner structure are made of L or T-shaped steel plates and fixed at the corner of the first insulating panel and panel and the second insulating panel with an angle range of 90 degrees to 135 degrees, and the L-shaped corner and T-shaped corner structure are made of stainless steel, 9% nickel steel plate, invar plate or aluminum alloy steel plate.

As a preferred embodiment of the present invention, the strength of the insulating panel is increased by adding glass fiber inside, and the reinforced polyurethane foam is formed by heating and foaming through a mixture of multiple chemical material formulations, which can play an excellent thermal insulation effect, said first insulating panel and second insulating panel are composed of multiple standard modular insulating panels spliced together, and the gap between two adjacent insulating panels and the periphery of the studs are also filled with filling Insulation block, said filling insulation block uses flexible insulation or rigid insulation or glass fiber insulation material in order to enhance the insulation effect, reduce the heat transfer inside and outside the cargo compartment.

As a preferred embodiment of the present invention, said stud for fixed installation of the first insulating panel is panel is made of stainless steel and is fixed to the hull plate by means of stored energy welding (capacitor discharge stud welding) or hand welding, and said stud for fixed installation of the second insulating panel is made of stainless steel and is fixed to the second metallic shielding membrane or pre-installed on the first insulating panel by panel by means of stored energy welding or hand welding.

Compared with the Prior Art, the Present Invention has the Following Beneficial Effects:

1. The invention replaces the existing membrane with metal membrane plates, reduces the reliance on proprietary equipment membrane, realizes global supply, replaces the existing membrane with metal membrane plate, reduces the application of low-temperature resistant glue for on-site construction, makes extensive use of the application of pre-insulated plates for workshops, reduces the workload and construction progress on site, and reduces the workload by using the more common and mature automatic welding and manual welding work for metal membrane plate.

2. This patent allows for modular supply, allowing for partial prefabrication before the ship is assembled, thus reducing the construction cycle.

3. The ship moves on waves, and the two layers of metal barriers avoid leakage and swaying, increasing the flexibility of the system. Two complete shielding membranes are used, utilizing a high-strength embossed corrugated sheet, which can absorb the deformation of the membrane due to thermal expansion and contraction on both longitudinal and transverse directions, and the insulation material is polyurethane foam and glass fiber, which improves the overall strength and increases the reliability and safety of the cargo hold. The main and second metallic shielding takes continuous arch corrugation to increase the ductility of the membrane plate, the design is simpler than the existing technology and reduces the cost; the continuous arch corrugation design can select the specific plate thickness and size according to the calculation and experiment, which is more flexible; the continuous arch corrugation increases the single plate area and reduces the welding workload of the cargo hold, and the corrugated plate is installed with reinforcement filler on the inner side without loading restriction, and the membrane is not easy to be damaged.

ILLUSTRATED WITH PICTURES

Figure 1:
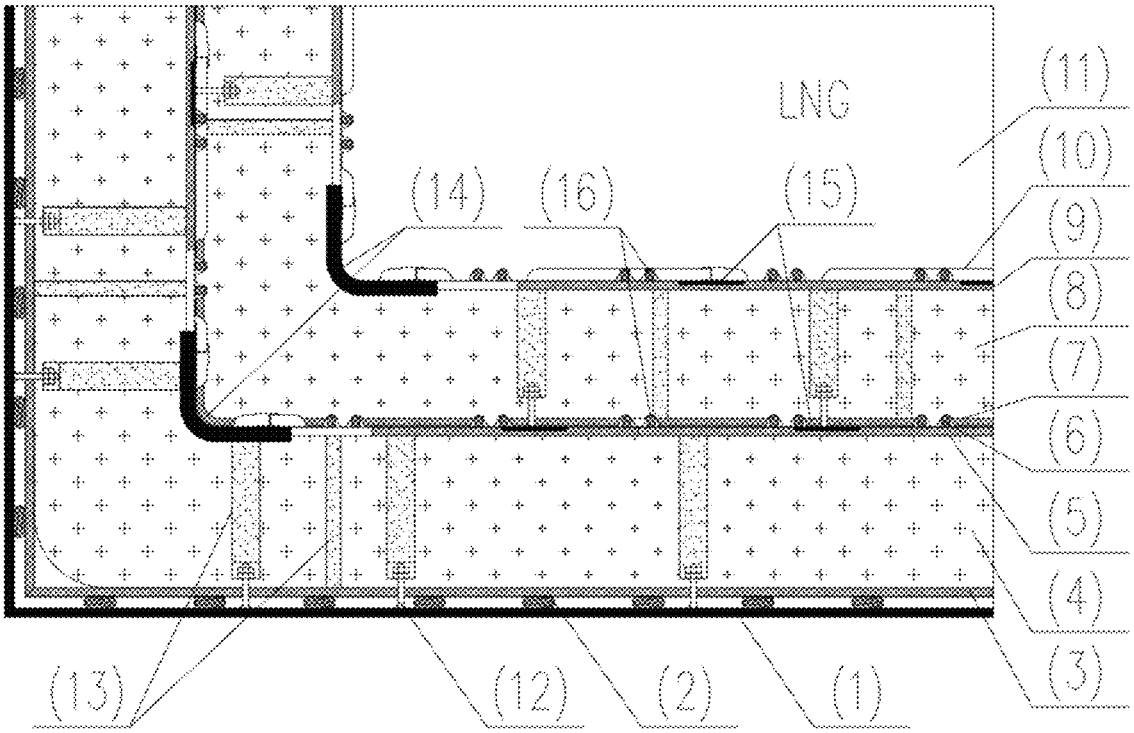
FIG. 1 shows a partial schematic view of the present invention.

In the FIGURE: 1) hull plate; 2) epoxy resin with hardener adhesive layer; 3) first support plate; 4) first insulating panel; 5) second support plate; 6) second metallic shielding membrane; 7) third support plate; 8) second insulating panel; 9) fourth support plate; 10) main metallic shielding membrane; 11) inner storage compartment; 12) studs; 13)

filling insulating block; 14) L-shaped corner structure; 15) strip steel plate; 16) reinforcing wedge; 26) T-shaped corner structure.

Specific Implementation

The following is a clear and complete description of the technical solutions in the embodiments of the present invention in conjunction with the accompanying drawings in the embodiments of the present invention, and it is clear that the described embodiments are only a part of the embodiments of the present invention, not all of them. Based on the embodiments in the present invention, all other embodiments obtained by a person of ordinary skill without making creative labor fall within the scope of protection of the present invention.

Referring to FIGS. 1-5, the present invention provides a technical solution: A bimetallic cryogenic membrane storage compartment for liquefied natural gas storage, characterized in that: said bimetallic cryogenic membrane storage compartment, in order from the outside to the inside, is provided with a hull plate 1, an epoxy resin with hardener adhesive layer 2, a first support plate 3, a first insulating panel 4 panel 4, a second support plate 5, a second metallic shielding membrane 6, a third support plate 7, a second insulating panel 8, a fourth support plate 9, a main metallic shielding membrane 10 and storage compartment 11, said first support plate 3 and first insulating panel 4 panel 4 are built with several sets of studs 12 and fixed to hull plate 1 by studs 12 and epoxy resin with hardener adhesive layer 2, several groups of said studs 12 are filled with filler insulation blocks 13 on the periphery, said first insulating panel 4 and second insulating panel 8 are composed of several standard modular insulating panels spliced together, the periphery of the gap between two adjacent insulating panels is also filled with filler insulation blocks 13, said first insulating panel 4 is connected to a second support board 5, the inner side of said second support board 5 is connected to a second metallic shielding membrane 6 and there are several sets of strip anchor steel plates 15 pre-buried at the connection, the inner side of said second metallic shielding membrane 6 is in contact with the third support plate 7, said second insulating panel 8 and first insulating panel 4 panel 4 are both provided with L-shaped corner structure 14 and T-shaped corner structure 26 at the corner of the boundary, the angle range of 90 degrees-135 degrees, two sets of said L-shaped corner structure 14 and T-shaped corner structure 26 are used to connect the corners of the second metallic shielding membrane 6 and the main metallic shielding membrane 10 respectively, the inner and outer sides of said second insulating panel 8 are connected with the third support plate 7 and the fourth support plate 9, and a number of sets of strip anchor steel plates 15 are also pre-buried on the fourth support plate 9, said fourth support plate 9 is connected with the main metallic shielding membrane 10, Said second metallic shielding membrane 6 and the main metallic shielding membrane 10 will have the reinforcing wedge 16 installed inside the corrugation, said second metallic shielding membrane 6 and the main metallic shielding membrane 10 are welded together by automatic welding or hand welding, in the installation process of said first insulating panel 4 panel 4 and the second insulating panel 8, all gaps will be filled by the use of flexible insulation or rigid insulation or glass fiber insulation.

Among them, stud 12 fixes the first insulating panel 4 panel 4 and the first supporting plate 3 on the hull plate 1, and the filling insulating block 13 fills in the gap of stud 12 to enhance the insulation effect and reduce the heat transfer inside and outside the compartment. The L-shaped corner structure 14 is L-shaped and fixed with the T-shaped corner structure 26 at the corner of the first insulating panel 4 panel 4 and the second foam insulating 8 plates, for the connection of the corners of the main shielding 10 and the second metallic shielding 6, respectively, with an angle of 90-135 degrees. The strip steel plate 15 is pre-buried on the second support plate 5 and the fourth support plate 9 for the connection between the standard modules of the primary main metallic shielding membrane 10 and the second metallic shielding membrane 6. Filler insulation block 13 is used for flexible insulation or rigid insulation, or fiberglass insulation to fill the gap between the first insulating panel 4 panel 4 and the second insulating panel 8 to reduce the effect of thermal expansion and contraction between insulating panels and the heat transfer inside and outside the compartment. Reinforcing wedge 16 is installed on the inner side of the corrugation of the second metallic shielding membrane 6 and the main metallic shielding membrane 10, which is used to reduce the impact of liquid shaking on the corrugation of the second metallic shielding membrane 6 and the main metallic shielding membrane 10, and play a role in strengthening the strength and buffering.

Further improved, as shown in FIG. 1: the first insulating panel 4 and the second insulating panel 8 are both made of reinforced polyurethane foam material and glass fiber material with a density of 20-300 kg/m3, the thickness of said first insulating panel 4 is 50 mm-500 mm, and the thickness of said second insulating panel 8 is 50 mm-500 mm.

Further improved, as shown in FIG. 1: the first support plate 3 and the first insulating panel 4 are contact with the hull plate 1 and fixed by the stud 12 and the epoxy resin with hardener adhesive layer 2, said epoxy resin with hardener adhesive layer 2 is made by mixing a high polymer and a curing agent.

Figure 2:
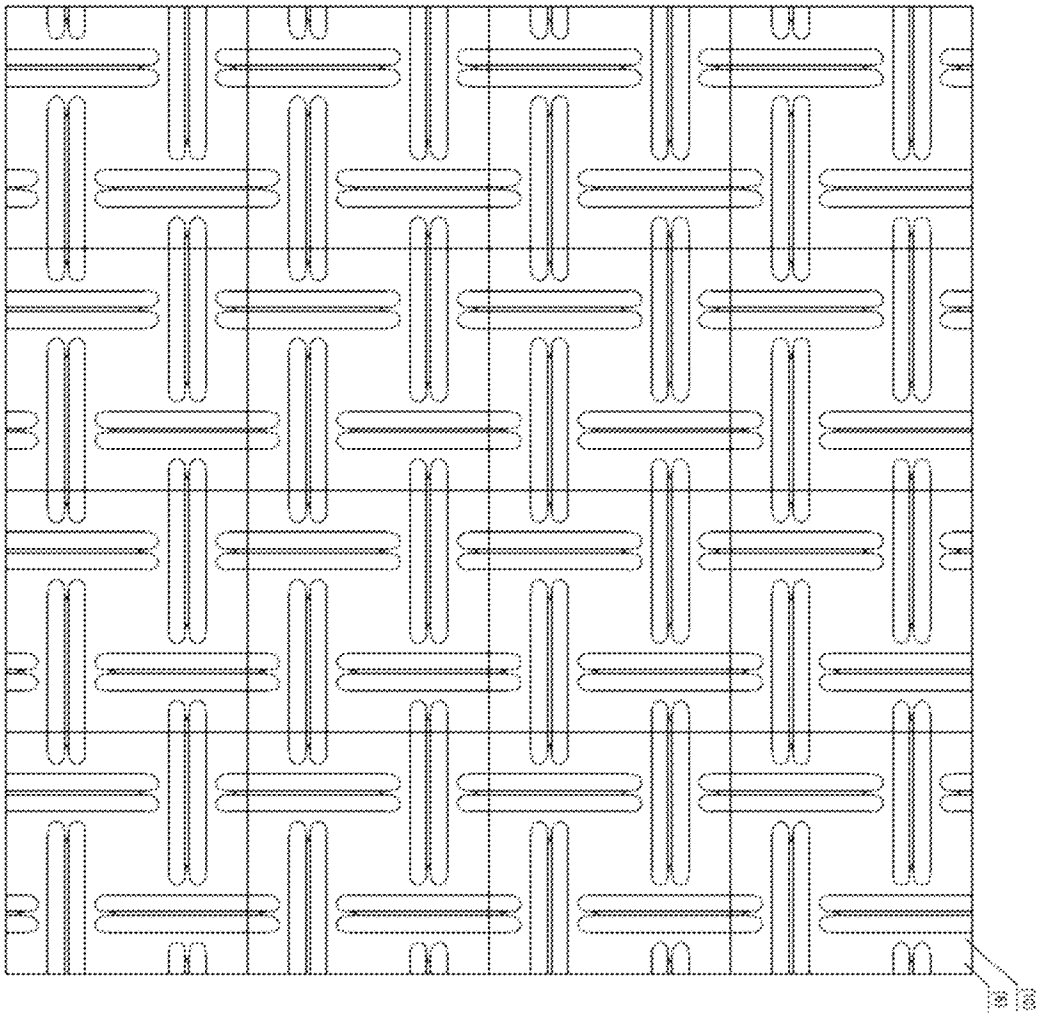
FIG. 2 shows the structure of the second metallic shielding membrane and the primary main metallic shielding membrane described in the present invention.
Figure 3:
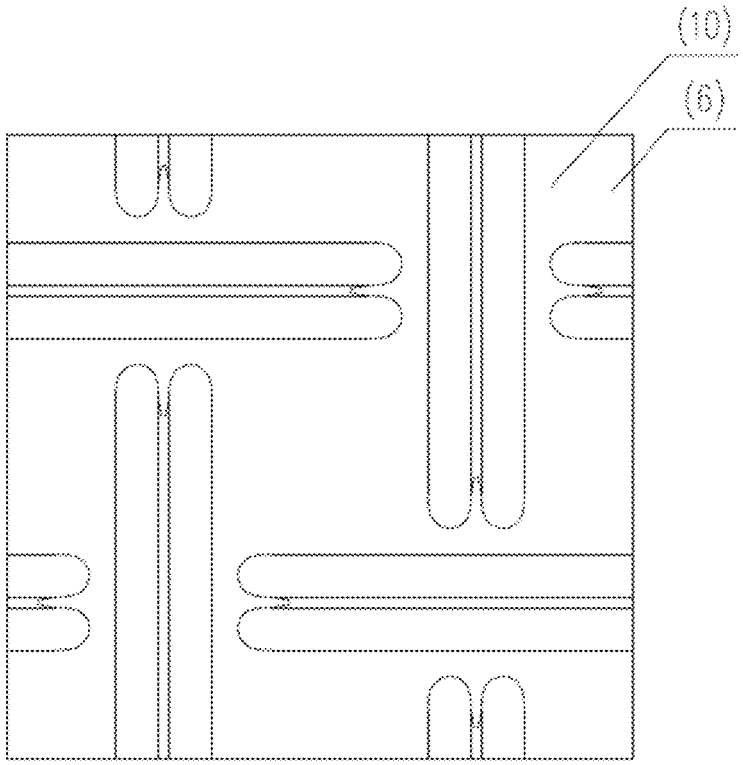
FIG. 3 shows a partial structure of the second metallic shielding membrane and the primary main metallic shielding membrane described in the present invention.
Figure 4:
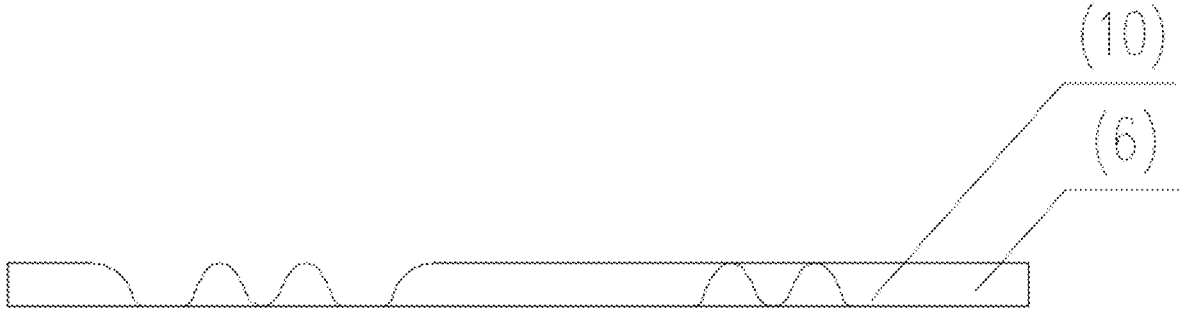
FIG. 4 shows the schematic diagram of the section of the second metallic shielding membrane and the primary main metallic shielding membrane described in the present invention.
Figure 5:
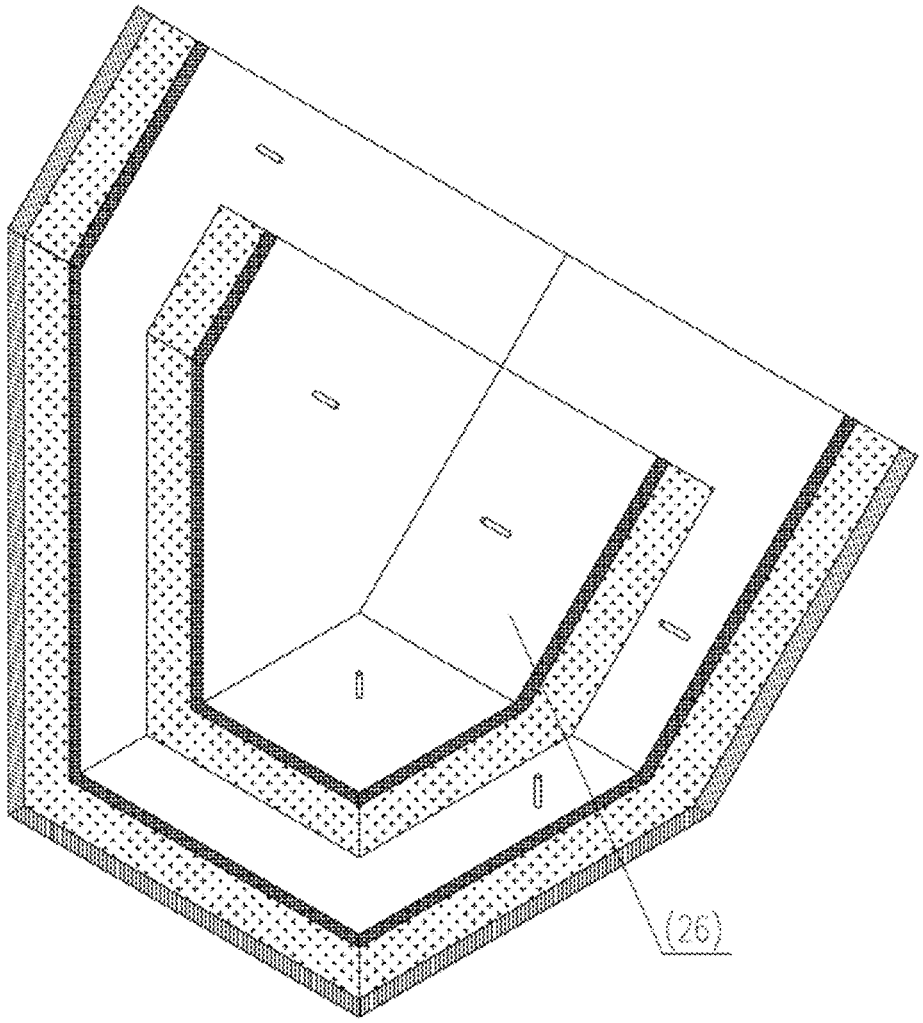
FIG. 5 shows a schematic diagram of the T-shaped corner structure described in the present invention.

Further improvements, as shown in FIGS. 2 to 4: the thickness of the second metallic shielding membrane 6 and the main metallic shielding membrane 10 are 0.5 mm-3.0 mm and made of stainless steel plate, 9% nickel steel plate, invar steel plate or aluminum alloy steel plate, the shapes of the said second metallic shielding membrane 6 and the main metallic shielding membrane 10 are continuous arch corrugated raised structure.

Further improvement, as shown in FIG. 1: the reinforcement wedge 16 is installed on the inside of the corrugation of the second metallic shielding membrane 6 and the main metallic shielding membrane 10, fixed to the surface of the fourth support plate 9 and the second support plate 5 by means of bonding or screws or bonding with screws. The reinforcement wedge 16 is made of wood, metal, or special materials.

Further improved, as shown in FIG. 1: the outer said strip anchor steel plate 15 is fixed on the surface of the second support plate 5 and is lap welded to the second metallic shielding membrane 6; the inner said strip anchor steel plate 15 is fixed on the surface of the fourth support plate 9 and is lap welded to the main metallic shielding membrane 10. The thickness of the strip anchor steel plate 15 is 3 mm-15 mm, and the material used is stainless steel plate, 9% nickel steel plate, invar steel plate, or aluminum alloy steel plate.

Further improved, as shown in FIG. 1: the first insulating panel 4 panel 4 and the second insulating panel 8 are connected to the support plates, the support plates are the first support plate 3, the second support plate 5, the third support plate 7, and the fourth support plate 9. Said support plates are made of wood plywood, glass fiber reinforced plastic, tetrafluoroethylene, polytetrafluoroethylene, or polyether ether ketone material; its thickness is 2 mm-30 mm, which increases the strength of the insulating panel, and are pre-buried with a strip of steel 15.

Further improvement, as shown in FIG. 1: L-shaped corner structure 14 and T-shaped corner structure 26 are made of L or T-shaped steel plate and fixed at the corner of the first insulating panel 4 panel 4 and the second insulating panel 8, the angle ranges from 90 degrees to 135 degrees, and the L-shaped corner structure 14 and T-shaped corner structure 26 are made of stainless steel, 9% nickel steel plate, invar steel or aluminum alloy.

Further improvement, as shown in FIG. 1: the material of the first insulating panel 4 and the second insulating panel 8 is glass fiber reinforced polyurethane foam, which increases the strength of the insulating panel by adding glass fibers; the reinforced polyurethane foam is formed by mixing and heating a variety of chemical material formulations, which can play an excellent thermal insulation effect. Said first insulating panel 4 and second insulating panel 8 are composed of a plurality of standard modular insulating panel splicing, adjacent to the two insulating panel gap and the periphery of the stud 12 is also filled with filler insulating block 13; said filler insulating block 13 using flexible insulation or rigid insulation or glass fiber insulation material, the purpose is to enhance the insulation effect and reduce the heat transfer inside and outside the cargo compartment.

Further improvement, as shown in FIG. 1: the stud 12 for the fixed installation of the first insulating panel 4 panel 4 is made of stainless steel and is fixed to the hull plate 1 by means of energy storage welding (capacitor discharge stud welding) or hand welding, and the stud 12 for the fixed installation of the second insulating panel 8 is made of stainless steel and is fixed to the second metallic shielding membrane 6 or pre-installed on the first insulating panel 4 panel 4 by means of energy storage welding or hand welding.

Pre-Construction Preparation:

Firstly, a set of modular scaffolding was designed for the cargo compartment, and corresponding working and storage platforms were provided to reach each area of the cargo compartment. Next, a high-precision laser scribing instrument is used to take point measurements of the cargo compartment surface, and the deviation value of the centerline of each surface and the cargo compartment grid line are calculated by the software, and based on the calculation results, the grid line is scribed on each cargo compartment surface by manual measurement and the position of the stud 12 is also scribed. The final adjustment of the reference plane of the cargo compartment is carried out by means of a support plate or a wedge made of PTFE.

Construction Procedures:

1) Epoxy Resin 2 Application:

Since the insulating panel of the cargo compartment enclosure system is composed of the prefabricated first insulating panel 4 and laid on the hull plate 1 through the stud 12 fixed and play a role in transferring the gravity of the cargo compartment, so considering the contact strength of the first insulating panel 4 and the hull plate 1, each first insulating panel 4 and the contact surface of the hull plate 1 are bonded 2 mm-30 mm thickness of the first support plate 3, in order to meet the requirement of flatness of the first insulating panel 4. When installing the first insulating panel 4, the epoxy resin strip 2 needs to be applied on the support plate in contact with the hull plate 1 in advance, and the epoxy resin 2 can be fully contacted with the hull plate 1 by extrusion during installation, and when applying the epoxy resin strip 2, a margin of at least 6 mm-8 mm height should be made to ensure that the contact width between the epoxy resin 2 and the hull plate 1 after the installation of the first insulating panel 4 reach a minimum of 10 mm-18 mm, so that the gravity in the cargo hold can be fully pressurized on the hull.

2) First Insulating Panel 4 Panel 4 and Second Insulating Panel 8 Modular Mounting:

Before the installation of the first insulating panel 4 panel 4, the surface of hull plate 1 should be painted in strict accordance with the paint construction standards, and the paint after construction should be tested for roughness check and tensile check, etc. The surface of the cargo compartment after painting needs to be well cleaned and dusted to ensure that there are no grease and rust stains and other garbage. The installation method is that the first insulating panel 4 coated with epoxy resin strip 2 is placed into the corresponding grid and then gradually positioned to guide the installation through the grid edge, alignment bolt hole, and bolt 12 positions, and then the stainless steel spacer or pressure plate and nut are initially tightened to fix the insulating panel, check whether the first insulating panel 4 is completely contacted and fitted with the wedge, and adjust the final position and height of the insulating panel by special tools, and ensure the height difference between two adjacent insulating panels is controlled below 0.7 mm, finally forming a complete second insulating panel plane panel plane.

The second insulating panel 8 is fixed on the second metallic shielding membrane 6 by bolts 13 pre-installed on the first insulating panel 4 panel 4 or on the strip steel plate 15, and the insulating box is positioned according to the bolt holes and slotted holes on the back, then the stainless steel spacer or pressure plate and nuts are tightened to fix the insulating panel, and the height difference between two adjacent insulating panels is controlled below 0.7 mm, which finally forms a complete plane of the main insulating panel. The next step is to install the main metallic shielding membrane 10, so the installation of the second insulating panel 8 needs to be done after the welding work of the second metallic shielding membrane 6, and the tightness test work is all finished.

3) Second Metallic Shielding Membrane 6 and Main Metallic Shielding Membrane 10 Installations:

After the installation of the first insulating panel 4 panel 4 and the second insulating panel 8 and the thermal protection for preventing burnout of the support plate in the specified area are completed, the installation of the second metallic shielding membrane 6 and the main metallic shielding membrane 10 can be carried out. The main principle of the installation of the second metallic shielding membrane 6 and the main metallic shielding membrane 10 corrugated plates is to ensure that the two lapped corrugated plates corrugated at the exact match lap to ensure the continuity of the corrugation; the continuity of the corrugation can be determined by marking on the strip steel plate (15) pre-buried on the support plate before the installation of the corrugated plate. The second metallic shielding membrane 6 and the main metallic shielding membrane 10 corrugated plates can be fixed on the strip steel plate 15 by intermittent welding beforehand so that the adjacent corrugated plate can lap with it more effectively. The welding of the second metallic shielding membrane 6 and the corrugated plate of the main metallic shielding membrane 10 can be carried out by automatic welding or hand welding.

4) Installation of the Reinforcement Wedge 16:

The second metallic shielding membrane 6 and the main metallic shielding membrane 10 should be installed with metal reinforcing wedge 16 at some special positions according to the different designs of the cabin capacity to increase the strength of the second metallic shielding membrane 6 and the corrugation of the main metallic shielding membrane 10. The reinforcing wedge 16 is fixed to the surface of the fourth support plate 9 and the second support plate 5 by gluing or screwing or gluing plus screwing, and the corrugations of the second metallic shielding membrane 6 and the main metallic shielding membrane 10 should be installed according to the position of the reinforcing wedge 16 correspondingly.

5) Tightness Test of the Cargo Compartment Insulation:

After the welding of the main metallic shielding membrane 10 and second metallic shielding membrane 6 is completed, all-welded areas should be subjected to the corresponding nondestructive flaw inspection; after passing the flaw inspection, both the main metallic shielding membrane 10 and second metallic shielding membrane 6 should be subjected to a complete gas tightness test, the ammonia or helium used for the tightness test can be injected and extracted through the pre-installed sampling line and nitrogen injection line under the main metallic shielding membrane 10 and second metallic shielding membrane Finally, it should be noted that the above description is only a preferred embodiment of the present invention and is not intended to limit the present invention. Although the present invention is described in detail with reference to the foregoing embodiments, it is still possible for a person skilled in the art to modify the technical solutions recorded in the foregoing embodiments or to make equivalent substitutions for some of the technical features. Any modification, equivalent replacement, improvement, etc., made within the spirit and principles of the present invention shall be included in the scope of protection of the present invention.

The invention claimed is:

1. A bimetallic cryogenic membrane storage compartment for liquefied natural gas storage, characterized in that: said bimetallic cryogenic membrane storage compartment, in order from the outside to the inside, is provided with a hull plate (1), an epoxy resin with hardener adhesive layer (2), a first support plate (3), a first insulating panel (4), a second support plate (5), a second metallic shielding membrane (6), a third support plate (7), a second insulating panel (8), a fourth support plate (9), a main metallic shielding membrane (10) and storage compartment (11), said first support plate (3) and first insulating panel (4) are built with several sets of studs (12) and fixed to hull plate (1) by studs (12) and epoxy resin with hardener adhesive layer (2), several groups of said studs (12) are filled with filler insulation blocks (13) on the periphery, said first insulating panel (4) and second insulating panel (8) are composed of several standard modular insulating panels spliced together, the periphery of the gap between two adjacent insulating panels is also filled with filler insulation blocks (13), said first insulating panel (4) is connected to a second support board (5), the inner side of said second support board (5) is connected to a second metallic shielding membrane (6) and there are several sets of strip anchor steel plates (15) pre-buried at the connection, the inner side of said second metallic shielding membrane (6) is in contact with the third support plate (7), said second insulating panel (8) and first insulating panel (4) are both provided with L-shaped corner structure (14) and T-shaped corner structure (26) at the corner of the tank boundary, the angle range of 90 degrees to 135 degrees, two sets of said L-shaped corner structure (14) and T-shaped corner structure (26) are used to connect the corners of the second metallic shielding membrane (6) and the main metallic shielding membrane (10) respectively and from two independent confined spaces, the inner and outer sides of said second insulating panel (8) are connected with the third support plate (7) and the fourth support plate (9), and a number of sets of strip anchor steel plates (15) are also pre-buried on the fourth support plate (9), said fourth support plate (9) is connected with the main metallic shielding membrane (10), said second metallic shielding membrane (6) and main metallic shielding membrane (10) are in the shape of a continuous arching corrugated bumpy structure said second metallic shielding membrane (6) and the main metallic shielding membrane (10) will have the reinforcing wedge (16) installed inside the corrugation, said second metallic shielding membrane (6) and the main metallic shielding membrane (10) are welded together by automatic welding or hand welding, in the installation process of said first insulating panel (4) and the second insulating panel (8), all gaps will be filled by the use of flexible insulation or rigid insulation or glass wool insulation.

2. A bimetallic cryogenic membrane storage compartment for liquefied natural gas storage according to claim 1, characterized in that: said first insulating panel (4) and said second insulating panel (8) are both made of reinforced polyurethane foam material and glass fiber material with a density of 20-300 kg/m3, the thickness of said first insulating panel (4) is 50 mm-500 mm, the thickness of said second insulating panel (8) thickness is 50 mm-500 mm.

3. A bimetallic cryogenic membrane storage compartment for liquefied natural gas storage according to claim 1, characterized in that in that: said first support plate (3) and first insulating panel (4) are in contact with the hull plate (1) and fixed by means of studs (12) and epoxy resin with hardener adhesive layer (2).

4. A bimetallic cryogenic membrane storage compartment for liquefied natural gas storage, according to claim 1, characterized in that the thickness of said second metallic shielding membrane (6) and main metallic shielding membrane (10) are both 0.5 mm-3.0 mm and made of stainless steel plate, 9% nickel steel plate, invar steel plate or aluminum alloy steel plate.

5. A bimetallic cryogenic membrane storage compartment for liquefied natural gas storage according to claim 1, characterized in that said reinforcing wedges (16) are all mounted on the inner side of the corrugations of the second metallic shielding membrane (6) and the main metallic shielding membrane (10) and are fixed to the surface of the fourth support plate (9) and the second support plate (5) by means of bonding or screwing or bonding with screws.

6. A bimetallic cryogenic membrane storage compartment for liquefied natural gas storage, according to claim 1, characterized in that the outer said strip steel plate (15) is fixed to the surface of the second support plate (5) and is lap welded to the second metallic shielding membrane (6), the inner said strip steel plate (15) is fixed to the surface of the fourth support plate (9) and is lap welded to the main metallic shielding membrane (10), the thickness of the strip steel plate (15) is 3 mm-15 mm, and the material used is stainless steel plate, 9% nickel steel plate, invar steel plate or aluminum alloy steel plate.

7. A bimetallic cryogenic membrane storage compartment for liquefied natural gas storage according to claim 1, characterized in that: said connected to the first insulating panel (4) as well as the second insulating panel (8) is a support plate, said support plate is the first support plate (3), the second support plate (5), the third support plate (7) and the fourth support plate (9), said support plate is made of wood plywood, fiberglass, tetrafluoroethylene, polytetrafluoroethylene or polyetheretherketone material, all of which are 2 mm-30 mm thick and serve to increase the strength of the insulating panel and are pre-buried with strip anchor steel plates (15).

8. A bimetallic cryogenic membrane storage compartment for liquefied natural gas storage, according to claim 1, characterized in that the L-shaped corner structure (14) and T-shaped corner structure (26) are made of L or T-shaped steel plates and fixed at the corners of the first insulating panel (4) and the second insulating panel (8) with an angle range of 90 degrees to 135 degrees, and the L-shaped corner structure (14) and T-shaped corner structure (26) are made of stainless steel, 9% nickel steel, invar or aluminum alloy steel.

9. A bimetallic cryogenic membrane storage compartment for liquefied natural gas storage according to claim 1, characterized in that: the material of said first insulating panel (4) and second insulating panel (8) is glass fiber reinforced polyurethane foam, which increases the strength of the insulating panel by adding glass fiber inside, and the reinforced polyurethane foam is formed by heating and foaming through a mixture of multiple chemical material formulations, which can play a good insulation effect, Said first insulating board (4) and second insulating board (8) are composed of a plurality of standard modular insulating board splicing, adjacent two insulating board gap and the periphery of the stud (12) is also filled with filler insulating block (13), said filler insulating block (13) uses flexible insulation or rigid insulation or glass fiber insulation material, in order to enhance the insulation effect and reduce the heat transfer inside and outside the cargo compartment.

10. A bimetallic cryogenic membrane storage compartment for liquefied natural gas storage according to claim 1, characterized in that said stud (12) for fixed installation of the first insulating panel (4) is made of stainless steel and is fixed to the hull plate (1) by means of capacitor discharge stud welding machine or manual welding, and said stud (12) for fixed installation of the second insulating panel (8) is made of stainless steel and is fixed to the second metallic shielding membrane (6) by means of auto welding machine or manual welding or is pre-installed on the first insulating panel (4).

* * * * *